US006394116B1

(12) United States Patent
Winn et al.

(10) Patent No.: US 6,394,116 B1
(45) Date of Patent: May 28, 2002

(54) ILLUMINATED WALKING ASSISTANCE APPARATUS

(76) Inventors: Ray Winn, 143 W. Victoria St., Long Beach, CA (US) 90805; Leslie Ridley-Tree, 204 Hot Springs Rd., Montecito, CA (US) 93108

( * ) Notice: Subject to any disclaimer, the term of this patent is extended or adjusted under 35 U.S.C. 154(b) by 0 days.

(21) Appl. No.: 10/051,654

(22) Filed: Oct. 25, 2001

(51) Int. Cl.[7] ..... A45B 3/02

(52) U.S. Cl. ..... 135/65; 135/910; 135/77; 362/102

(58) Field of Search ..... 362/102; 135/65, 135/77, 910

(56) References Cited

U.S. PATENT DOCUMENTS 1,427,138 A * 8/1922 Walicki et al.
2,271,190 A * 1/1942 Giamo
4,013,881 A * 3/1977 Sargent
4,062,371 A * 12/1977 Bolen ..... 135/66
4,562,850 A * 1/1986 Earley et al. ..... 135/66
4,625,742 A * 12/1986 Phillips ..... 135/66
5,331,990 A * 7/1994 Hall et al. ..... 135/65
5,351,704 A * 10/1994 Hunnicutt et al. ..... 135/66
5,582,196 A * 12/1996 Hae et al. ..... 135/65
5,595,434 A * 1/1997 Pasch et al. ..... 362/102
6,267,481 B1 * 7/2001 Yang ..... 362/102

* cited by examiner

*Primary Examiner*—Robert Canfield
(74) *Attorney, Agent, or Firm*—Fulbright & Jaworski L.L.P.

(57) ABSTRACT

An illuminated walking assistance apparatus in the form of a staff having a light pipe in the lower portion thereof which provides diffused illumination in the immediate vicinity of the apparatus and at the same time, a bright light visible for a substantial distance to alert or signal others.

10 Claims, 5 Drawing Sheets

FIG. 6
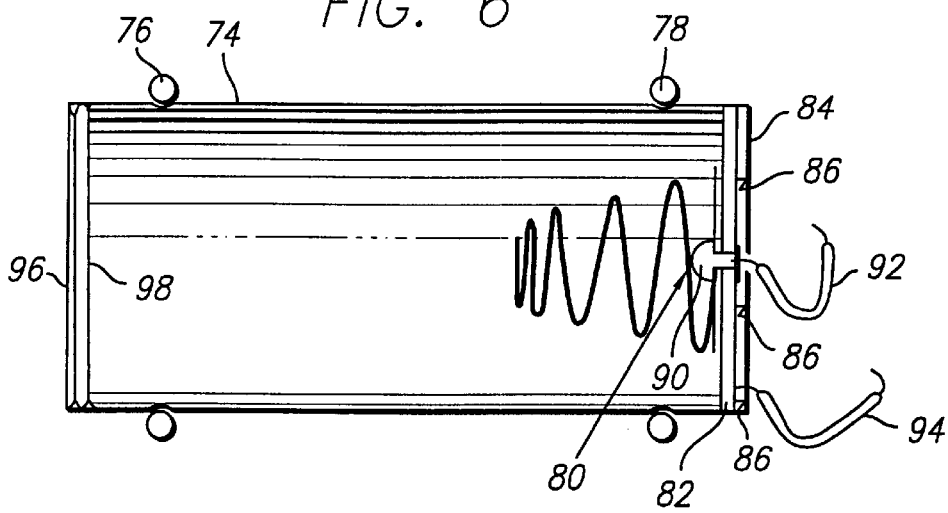
FIG. 7
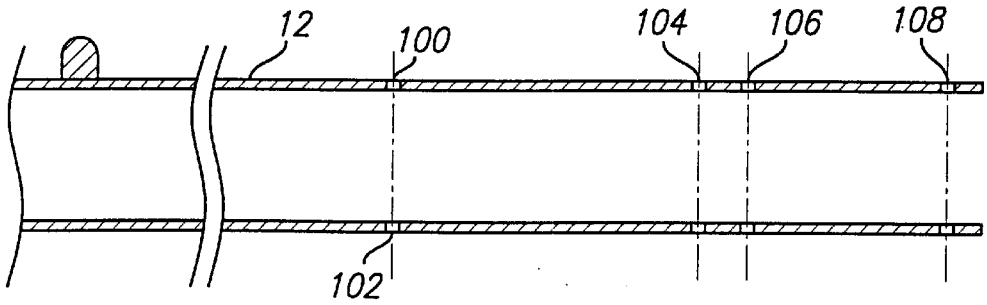
FIG. 8
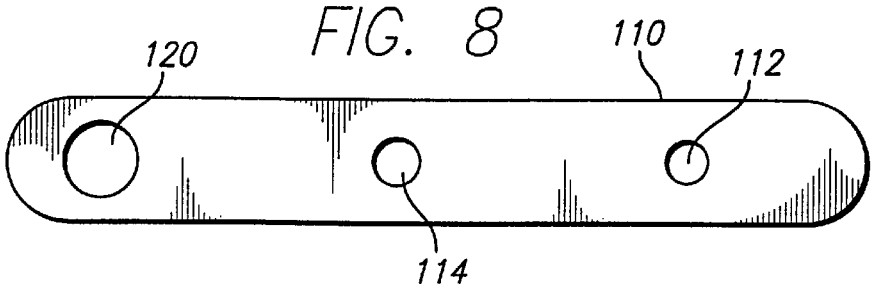
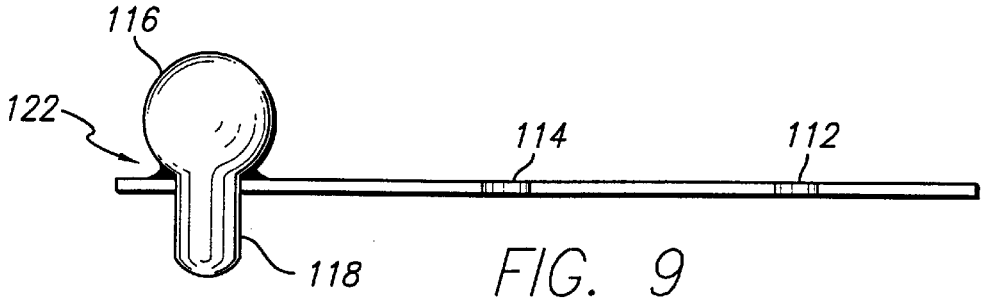
FIG. 9

ILLUMINATED WALKING ASSISTANCE APPARATUS

FIELD OF THE INVENTION

The present invention relates generally to apparatus for assisting individuals in walking and more particularly to such an apparatus which carries as an integrated portion thereof a light pipe which provides general illumination of a diffused nature in the immediate vicinity of the apparatus. Such light can assist elderly or handicapped individuals to be more efficiently ambulatory in darkened areas or regions of low light level while at the same time providing a small area of bright light which may be visible for a substantial distance and can be used to signal others but at the same time is not visible by the user of the apparatus. The apparatus may also be used by hikers or walkers.

DESCRIPTION OF THE PRIOR ART

The prior art discloses a multitude of devices having self-contained illumination apparatus therein which are used either to aid persons in seeing better or used as a beacon or the like to designate the users position to others. Light sources have been incorporated into the elongated shaft of the device or attached thereto in a manner to cast light for use by the user. The light source in such prior art devices include various types of apparatus such as a gas-filled tube light, a halogen bulb, a flourescent bulb or an incandescent bulb or the like. In all such instances, the device also utilizes appropriate battery, switch and electrical wiring means for activating the illumination source or deactivating it as may be required.

Many of the prior art devices are constructed as separate walking canes or as apparatus adapted for attachment to. standard existing walking canes. In both instances, the devices disclosed in the prior art are of complicated mechanical assemblies which are extremely complex or require tooling costs that are extensive enough as to render the prior art walking cane too expensive for commercial production and sale.

Filippino U.S. Pat. No. 6,145,993 dated Nov. 14, 2000 discloses an integrated unit of hard transparent or translucent acrylic material formed with a light source, batteries, switch and conducting wires which integrated unit may be attached to a cane by either knot or slide means for purposes of signaling others of a sight handicapped user's needs.

Yung U.S. Pat. No. 5,810,466 dated Sep. 22, 1998 discloses a walking cane having a flashlight in the handle to project light forwardly to illuminate a travel path for the user and an elongated gas filled tube light in the staff for general illumination around the area of the cane.

Leffingwell et. al., U.S. Pat. No. 5,577,827 dated Nov. 26, 1996 is a cane device with an alarm and a lighted end.

Hall et. al., U.S. Pat. No. 5,331,990 dated Jul. 26, 1994, is a safety cane device, which is also connected to a telephone alarm system. A lighted window in the cane's shaft aids the user's sight.

Hunnicutt, Jr. et al., U.S. Pat. No. 5,351,704 dated Oct. 4, 1994, provides for a lighted walking cane, with a body and ground tip composed of a clear-rubber material with reflecting means to supply light in a specific direction. Illuminating means and the circuit are housed in different portions of the cane.

Ragatz, U.S. Pat. No. 5,197,501 dated Mar. 30, 1993, is a lighted cane housing two light sources and an alarm. The switch and battery are housed separately from the light units.

The light in the conventional opaque ground tip portion of Rogatz's invention is positioned to direct reflected light longitudinally along the shaft.

Earley et al., U.S. Pat. No. 4,562,850, dated Jan. 7, 1986, houses the switch in the handle, while the illumination device is near the base of the cane.

Phillips, U.S. Pat. No. 4,625,742 dated Dec. 2, 1986, is a cane that is used for lighting the user's walkway as well as a beacon for others to see the user. The light emitting end portion (ground tip) is translucent or transparent. The light source and battery are housed separately from the switch.

Hubachek, U.S. Pat. No. 4,099,535, dated Jul. 11, 1978, is for a walking cane for the blind; visible day or night, with a portion of the cane shaft above the ground tip having a window for the emission of light. The wear tip or ground engaging member is made of a conventional, opaque material. The switch is in the handle.

Varnell, U.S. Pat. No. 3,987,807, dated Oct. 26, 1976, has a light at the end of the tip of the cane, operated by a switch in the handle. Its purpose is to allow the user to see in dark corners and around areas.

Caustin, U.S. Pat. No. 2,642,519, dated Jun. 27, 1949, allows for motorists and drivers of vehicles to be able to see and recognize the user's affliction. The light travels through the shaft length. The ground tip is made from material that obstructs the light from the end of the shaft.

Giaimo, U.S. Pat. No. 2,271,190 dated Jun. 8, 1940, is for illuminating the region where the cane is to be placed.

Although the disclosed prior art devices function for the purpose intended the need remains for an illuminated walking assistance apparatus which provides simultaneously a bright beacon light type for signaling or warning purposes and which is not readily visible to the user and a diffused light for use in the immediate vicinity of the apparatus to illuminate the pathway of the user which is simple, easy to use and maintain and is economical to construct.

SUMMARY OF THE INVENTION

An illuminated walking assistance apparatus having an elongated shaft which includes a lower section formed from a light pipe having a transparent portion and a frosted portion and defining a cavity within which a light source is received. The apparatus also includes a source of electrical energy and switch and wiring means for activating or deactivating the source of illumination.

BRIEF DESCRIPTION OF THE DRAWINGS

FIG. 6 is a side view in cross section of the battery holder;

FIG. 7 is a partial view of the central section of a walking cane modified to accept the light pipe and illumination source of the present invention;

FIGS. 8 and 9 illustrate a latching mechanism attached to the exterior of the cane for securing or releasing the light pipe to replace the illumination source retained therein shown in elevation and side view respectively;

DESCRIPTION OF THE PREFERRED EMBODIMENT

Figure 1:
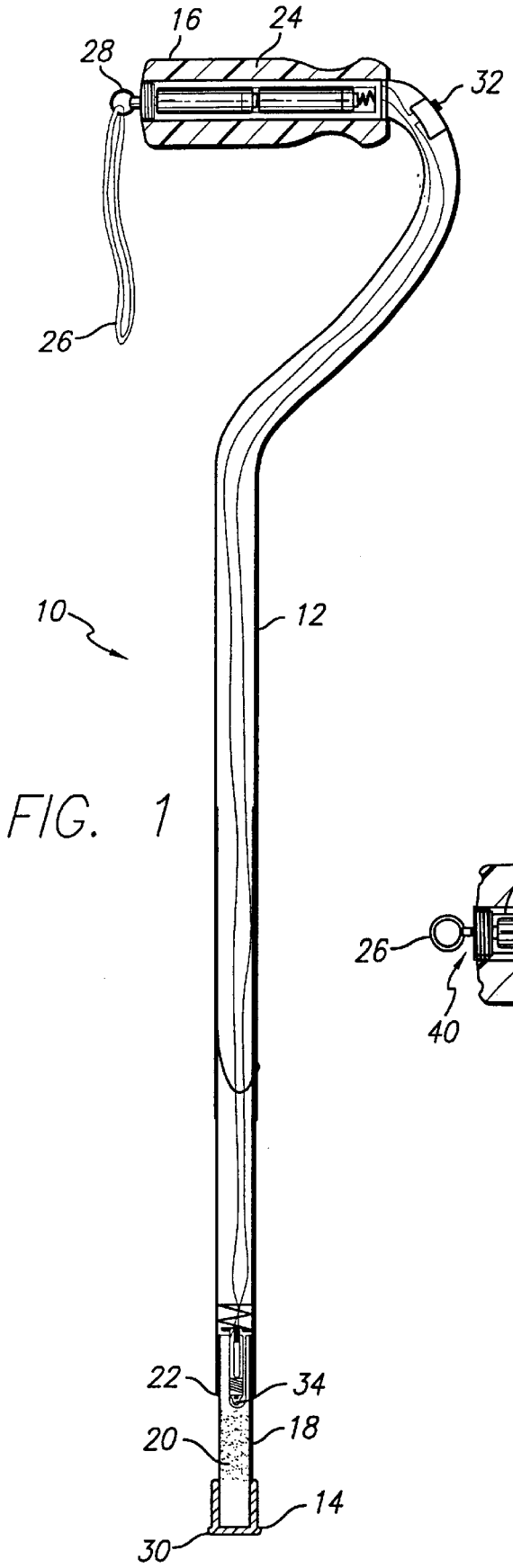
FIG. 1 is a plan view in cross section of an illuminated walking assistance in the form of a constructed in accordance with the principles of the present invention.

The walking assistance apparatus of the present invention may take many forms and be used for various purposes. However, for ease of illustration and description, the following description is presented using a walking cane as the specific apparatus incorporating the invention. Such is however not to be taken as a limitation as to the scope of the claims. The illuminated apparatus of the present invention provides sufficient illumination to light the pathway of the cane user during night time or reduced light situations and at the same time provides sufficient illumination in the form of a bright light to provide notification to others of the users presence. The illuminated apparatus of the present invention is an economical, easy to use product employing in one form a modified typical walking cane of the type commonly used by persons who require the use of a cane but the modifications are done in such a manner as to not attract undue attention. The cane is easy to use, its length can be adjustable, it can be easily maintained. It has a substantially long battery life and the batteries and light bulb are easily replaceable and if desired can be recharged.

Although the general idea of a lighted cane is disclosed in the prior art, and has been for a substantial period of time as shown by the above-referenced prior art patents, none of the prior art discloses the utilization of a light pipe disposed in the lower portion of the cane with the illumination source retained within a cavity formed in the light pipe in such a manner as to provide a bright point source of light not visible to the user under normal use circumstances but readily visible to a distant viewer but at the same time providing sufficient illumination to light the pathway of the cane user. This dual light source is provided by dividing the light pipe into a frosted or diffused portion and a clear or polished portion with the illumination source disposed at the clear or polished portion. The end of the light pipe opposite the illumination source has been polished and is fitted with a reflector so that the light from the illumination source passes multiple times through the light pipe and as a result of the frosted or diffused surface is caused to emanate in a diffused pattern to provide sufficient illumination to light the pathway of the cane user near the tip of the cane. This combination of the bright light and the diffused light provides to the cane user a number of advantages among which are:

1. Its use as a signaling device to attract attention at night, for example, of taxi or bus drivers or to warn others as to the presence of the cane user.
2. To provide illumination for use as an aid in negotiating night time trips to the bathroom or kitchen without turning on room lights thus preventing disruption of night vision or interfering with another person's sleep.
3. To provide light for use in searching in dark spaces such as closets for misplaced items and to assist in retrieving them.
4. To provide light to assist in finding seat numbers at the theater and sporting events.
5. To provide a source of light for use as a convenient aid in finding and dialing a bedside phone without resorting to bright room light.
6. To provide sufficient light for use in finding nearby misplaced items such as a TV remote control or telephone.
7. To provide light for locating bedside items such a glass of water or medicines.

Other advantages and uses for the present invention will become apparent to those skilled in the art and to users of the present invention.

Referring now to the drawings and more particularly to FIG. 1. There is shown generally at 10 a schematic diagram of an illuminated cane constructed in accordance with the principles of the present invention. The present invention may be incorporated as part of an umbrella, a hiking stick or other similar apparatus. The cane 10 includes an elongated staff 12 which has a ground engaging tip 14 at one end thereof and a handle 16 at the other end thereof. The elongated staff 12 includes a light pipe 18 disposed adjacent the tip portion 14. The light pipe 18 includes a frosted or diffused section 20 and clear or polished section 22. The cane 10 is a standard off the shelf walking cane of the type sold by Medline Industries which is readily recognizable by those who normally use walking canes for assistance in being ambulatory. The cane has been modified to receive batteries and the light pipe 18 as will be more fully discussed below. This cane is constructed of high tensile strength aluminum and has a foam rubber hand grip 24. The cane also is adjustable in length for use by different users. The handle 16 includes a hand loop 26 which passes through a strap ring 28 affixed to the end of the handle 16 to present dropping the cane during use thereof. Although the handle is shown curved and disposed orthognal to the staff it should be recognized that the handle may be straight and inline with staff or otherwise disposed. The tip 14 is typically covered by a rubber tip 30 as is well known to those skilled in the art. As illustrated the rubber tip 30 fits over the lower most end of the light pipe 18. A switch 32 is provided adjacent the handle 16 for easy access by the user so that upon being closed the electrical circuit provides electrical energy to a source of illumination such as a lamp 34 to activate the source of illumination. The switch 32 can be of the push button, membrane, rocker, or toggle type as well as a typical slide switch.

When the switch 32 is closed and the source of illumination 34 emanates light, the light passes through the light pipe 20 and a portion thereof emanates more or less horizontally through the clear or polished section 22, disposed immediately adjacent the filament of the source 34 to create a bright light readily visible by distant viewers as well as causing the light within the light pipe to be diff-used through the frosted or diffused section 20 to provide illumination around the cane 10 to light the pathway of the user.

Figure 2:
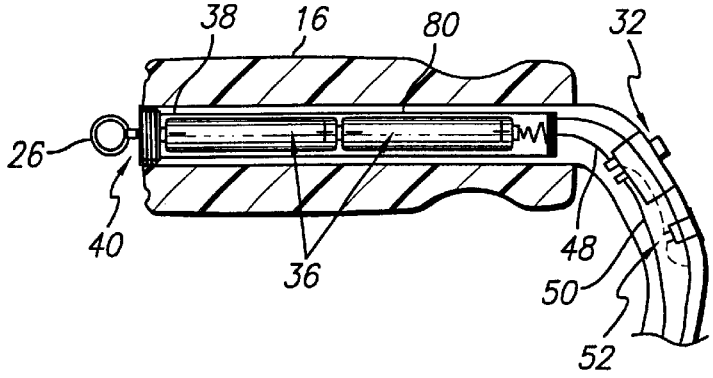
FIG. 2 is a fragmented view of the handle portion thereof showing the battery and switch housing.
Figure 3:
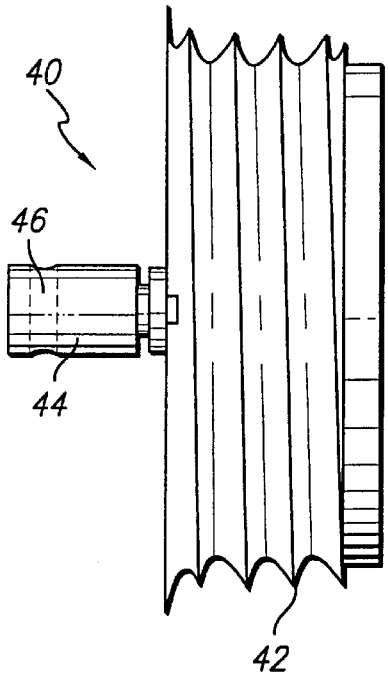
FIG. 3 is a side elevational view of the plug which retains the batteries in place.

More detailed information is provided with regard to the handle 16 in FIGS. 2 and 3 to which reference is hereby made. As is therein shown, the handle 16 has been modified to receive a pair of batteries 36. The batteries may be any size which normally can be used for such a device and in accordance with the preferred embodiment of the present invention are the typical "AA" dry cell batteries providing 1.5 volts each. The batteries are disposed within a holder 38 which is closed by a cap 40 which is shown in greater detail in FIG. 3. The Cap 40 is provided with a plurality of threads 42 so that it may be threadably secured to the holder 38 and in so doing will provide pressure against the batteries 36 so that they make appropriate contact for completion of the electrical circuit as more fully described below. The cap 40 includes a ring retainer 44 defining a through opening 46 therein for purposes of receiving the ring 28 to which the loop 26 is attached. As is shown in FIG. 2, the switch 32 is secured to the outer surface of the staff 12 of the cane 10 and has electrical leads 48 and 50 attached thereto for closing the electrical circuit to provide electrical energy to activate the light emitting member 34. If desired, a battery charging connection 52 may be included and connected with the electrical circuit as shown by dashed lines. Obviously, if such an additional component is provided in the cane 10, the batteries 36 would necessarily be of the type that could be recharged and thus would prolong the life of the batteries accordingly.

Figure 5:
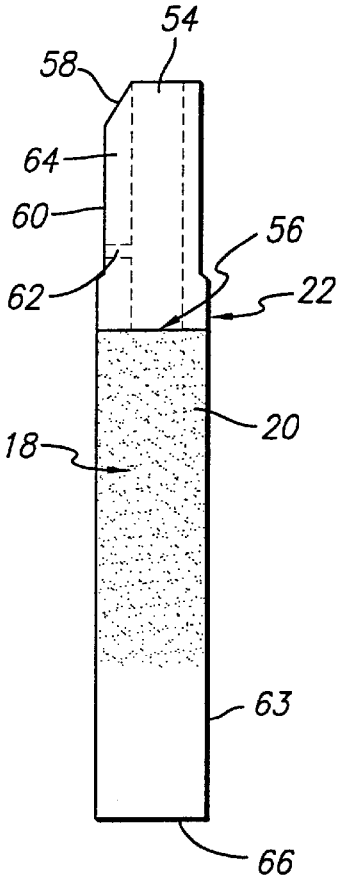
FIG. 5 is a side elevational view of the light pipe as used in the lower portion of the cane of the present invention.
Figure 4:
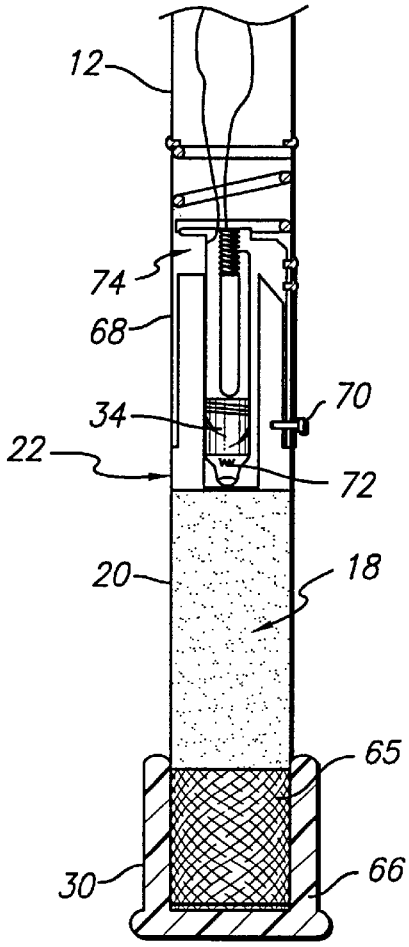
FIG. 4 is a fragmentary view of the lower portion of the cane as shown in FIG. 1 which illustrates the light pipe and illumination source thereof.

The lower section of the cane 10 including the light pipe 18 is more fully illustrated in FIGS. 4 and 5 to which reference is hereby. As is illustrated particularly in FIG. 5, the light pipe 18 is constructed from an elongated injection molded acrylic or other suitable plastic preferably in the form of a cylinder. The outer surface of the center section of the light pipe is "frosted" as shown at 20. Such frosting is provided by forming discontinuities in the outer surface of the light pipe 18 at the time of molding or machining the tubular acrylic plastic member or after injection molding by sand blasting or a chemical or other appropriate treatment. Alternatively, if the light pipe 18 is formed by being machined, then the outer surface can be "frosted" through sand blasting, chemical treatment or other similar techniques. The purpose of such frosting is to cause the light which travels through the light pipe to become diffused and leave the light pipe along this surface. That is, what is formed by this technique is a lossy light pipe insofar as the section 20 is concerned. The remainder of the light pipe is preferably clear and in fact in certain areas is highly polished so as to cause the light appearing therein to be visible without being diffused as is the case with the frosted section 20. This is particularly important with regard to the clear or polished section 22 as will become more clear hereinafter. The light pipe is formed with a bore 54 which has a blind bottom 56. The blind bottom 56 is also highly polished for reasons to become apparent hereinafter. The upper end of the light pipe is beveled as shown at 58 to allow easy insertion of the light pipe into the end of the staff 12. The upper portion 60 of the light pipe is reduced in diameter so as to have an outside diameter which is substantially equivalent to the inside diameter of the staff 12. An opening 62 is provided through the wall 64 to receive a detent formed as a part of the tip release mechanism to be described more fully hereinafter and to function to retain the light pipe within the lower end of the staff 12. A reflector 66 is disposed across the highly polished lower end of the light pipe 18. If desired, the lower section 63 of the light pipe may also be covered with a reflector 65 which may be in the form of a reflective paint or a reflective foil which would be covered by the tip 30.

The light pipe as illustrated in FIG. 5 and above described is received within the lower end of the staff 12 as more fully illustrated in FIG. 4 to which reference is hereby made. As is therein illustrated the light pipe 18 having the rubber tip 30 thereon is inserted into the lower end 68 of the staff 12. A detent or pin 70 is received within the opening 62 to hold the light pipe in place within the end 68 of the staff 12. Disposed within the bore 54 of the light pipe 18 is an illumination source in the form of a prefocused or ordinary light bulb 34 which has its filament 72 disposed immediately adjacent the clear or polished section 22 of the light pipe 18 which terminates at the blind bottom 56 of the bore 54. The bulb 34 is preferably a pre-focused bulb which causes the light emanating from the filament 72 to be focused to travel through the light pipe 18 toward the reflector 66. That is the reason for the blind bottom 56 of the lower 54 to be highly polished. Shown generally at 74 are appropriate electrical connections and supporting structure to provide means for supplying electrical energy to the bulb 34 when the switch 32 is closed to cause it to emit illumination from its filament 72. This structure will be described in greater detail herein below in conjunction with FIGS. 10, 11 and 12.

Referring now more particularly to FIG. 6. There is illustrated the apparatus for converting the handle 16 of the cane 10 to receive the batteries 36. An electrically conductive tube 74 is provided and is sized to snugly receive the batteries 36 therein. The tube 74 may be constructed of any material desired but preferably is constructed of brass. A pair of O-rings 76 and 78 are secured in place about the outer periphery of the brass tube 74 to snugly secure the tube 74 within a recess 80 provided in the handle 16. An insulating washer 82 is supported against the end 84 of the tube 74 by appropriate standoffs 86 formed therein. A spring 88 of electrically conductive material is secured by a rivet 90 to the washer 82 and provides one electrical contact to the batteries 36. An appropriate electrical conductor 92 is electrically connected to the rivet 90 and passes through an opening in the end 84 of the tube 74. An additional electrical wire 94 is electrically connected to the inside of the wall 84 of the tube 74 thus, providing the other electrical connection for the batteries 36. The open end of the cane handle is formed with a plurality of threads for threadably receiving the cap 40 (FIG. 3) which is formed of electrically conductive material such for example as zinc. As a result when the batteries are in place internally of the tube 74 and the cap 40 is secured the electrical connection is established between the cap and the end of the tube and thus positive and negative terminals of the batteries 36 to the electrical leads 92 and 94 so that when the switch 32 is closed the light 34 is activated. Alternatively, the open end 96 of the table 74 may be formed with threads 98 and the cap would be secured by the threads thereon engaging thereon engaging the same.

FIG. 7 to which is reference is hereby made illustrates modifications to the lower end of the staff 12 for the purpose of receiving the light pipe 18. The first modification which is made is to remove the lower portion of the cane shaft as received from the manufacturer. Various amounts can be removed depending upon the specific dimensions of the light pipe but on the order of 3 to 4 inches is normally sufficient. The shaft 12 is then drilled to provide openings 100 through 108 therein. Openings 100 and 102 are opposed and pass through the wall of the shaft 12 and are aligned. These openings receive stop devices to prevent movement of a spring which will be disposed internally of the shaft 12 as will be more fully describe herein below. The openings 104 and 106 receive attachment rivets to secure the light pipe tip release mechanism illustrated in FIGS. 8 and 9. The opening 108 is to provide access for the detent or pin which enters the opening 62 in the light pipe to retain the light pipe in position at the lower end of the shaft 12.

FIGS. 8 and 9 illustrate the tip release mechanism 70 and as is therein shown this device includes a flexible spring-like strap 110 having a pair of openings 112 and 114 formed therein. The openings 112 and 114 are aligned with openings 104 and 106 on the shaft 12 and rivets or other types of fasteners are utilized to secure the strap 110 to the outer surface of the shaft 12. A release mechanism in the form of a gripping member in the form of a ball 116 or the like and having a detent or pin 118 extending therefrom to enter the opening 62 in the light pipe 18 is secured in place through an additional opening 120 on the strap 110. The ball and pin may be secured to the strap 110 by soldering, welding, brazing or the like as illustrated generally at 122.

Figure 10:
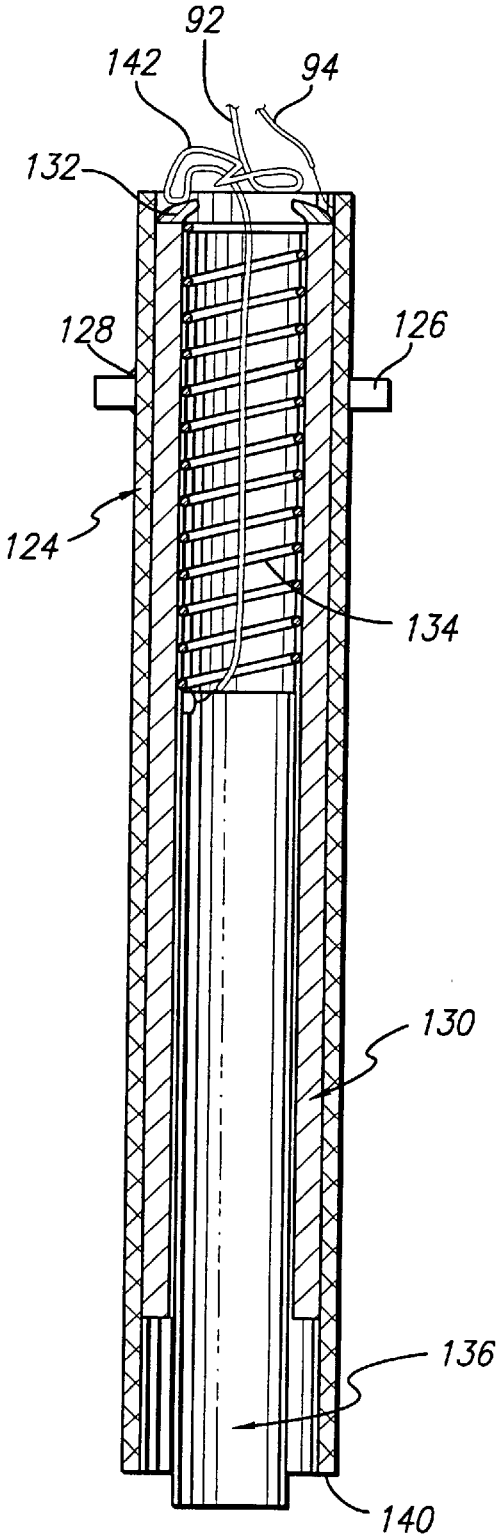
FIG. 10 illustrates in cross section the lamp contact assembly as used in present invention.
Figure 11:
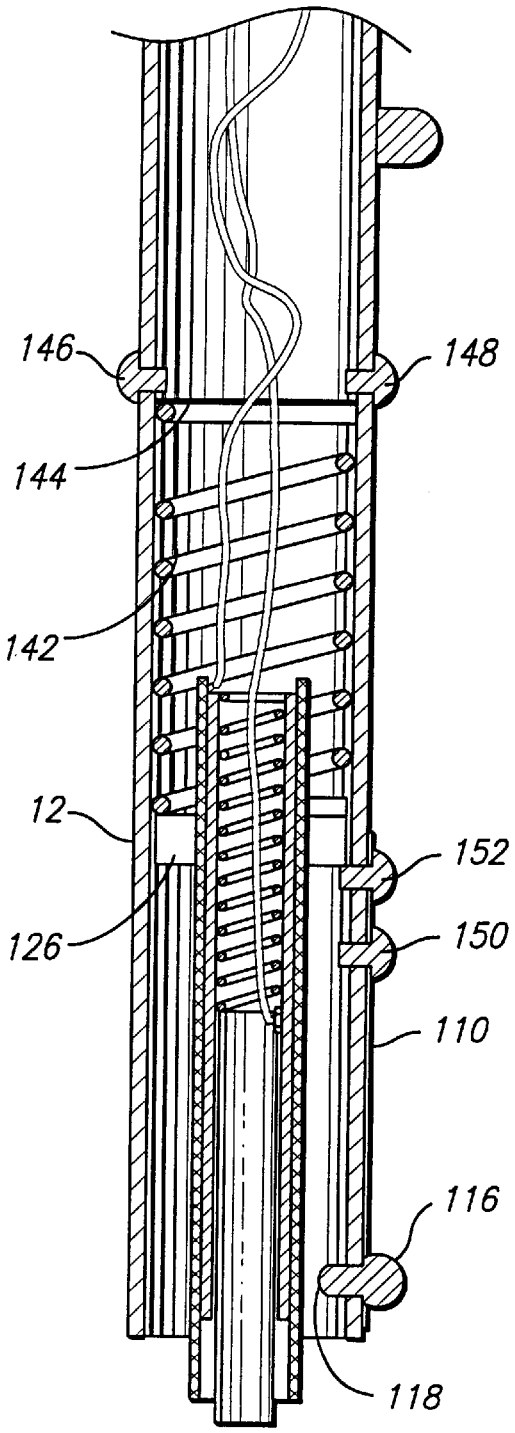
FIG. 11 illustrates the lamp contact assembly of FIG. 10 disposed with in the lower portion of the cane.
Figure 12:
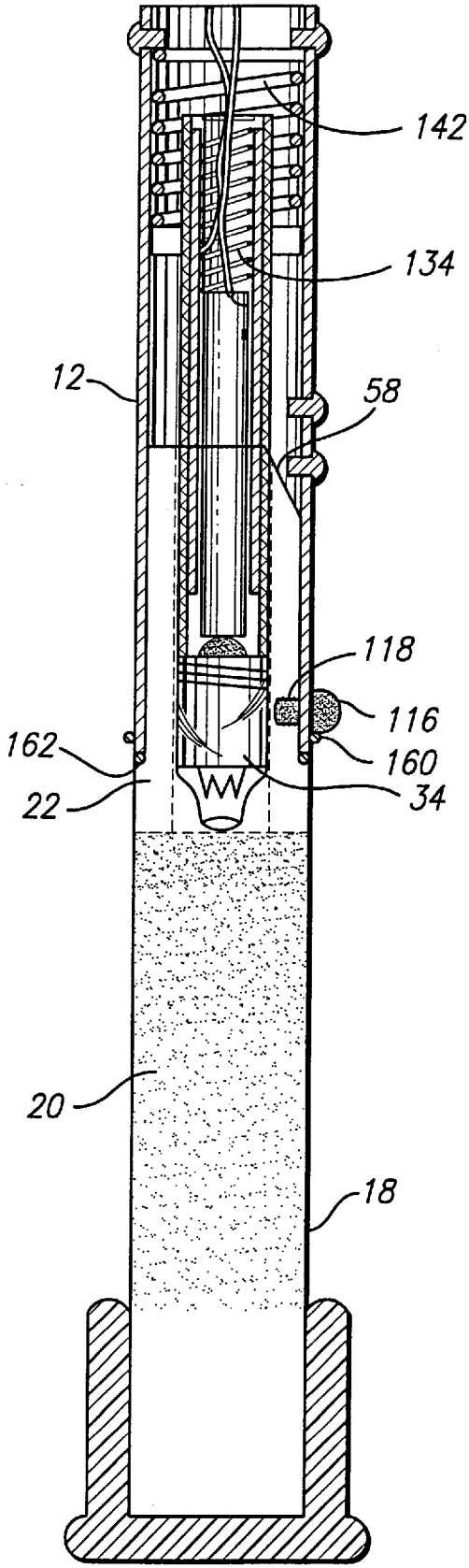
FIG. 12 is a cross sectional view the lower portion of the cane fully assembled.

Referring now more particular to FIGS. 10, 11 and 12 there is illustrated respectively the configuration of the lamp contact assembly, the lamp contact assembly disposed internally of the lower end of the cane shaft and the final assembly with the light pipe and bulb in place therein. As is shown in FIG. 10, there is provided an outside tube 124 of electrically conductive material to which the electrical lead 94 is secured. A thrust washer 126 is press fitted to the outer surface of the tube 124 and is held in place by a fastening means such as solder 128 or the like. An insulator tube 130 is deformed at one end as shown at 132 in order to retain the lamp contact spring 134 internally of the insulator tube 130. The electrical lead 92 is then soldered to the internal surface of the inner tube 136. The loose end of lead 92 is then threaded through the spring 134 and through the insulator tube 130. The lead is then pulled to compress the spring 134 until the end 138 of the inner tube 136 is even with the end 140 of the outside tube 124. A knot 142 is then tied in the lead 192 to secure it. When the wire is released, the inner tube will spring out slightly.

As shown in FIG. 11, the sub-assembly as shown in FIG. 10 is disposed internally of the lower end of the shaft 12. A compression spring 142 is inserted into place internally of the shaft 12 until the upper portion 144 thereof contacts the spring retainers 146 and 148 which may be rivets which have been inserted through the openings 100 and 102 formed through the shaft 12. The thrust washer 126 contacts the opposite end of the spring 142 and is pushed upwardly by force on the outer tube 124 until the lower end of the thrust washer 126 passes the opening 104 in the shaft 12. The strap 110 is then secured in place by rivets 150 and 152 with rivet 152 also serving as a stop for the thrust washer 126.

When thus secured in place, as shown in FIG. 1 the light pipe 18 may then be inserted into the lower end of the shaft 12 by having the beveled surface 58 engage the inner edge of the pin 118 forcing it outward to permit the light pipe 18 to enter the lower end of the shaft 12 until the opening 62 aligns with the pin 118 at which time it enters the opening 62 to secure the light pipe in place. As is illustrated in FIG. 12 the bulb 34 has been dropped into place within the cavity 54 prior to the light pipe being inserted into the lower portion of the cane 12. The inner and outer tubes 136 and 124 are moved upwardly against the compression of the springs 134 and 142 respectively, by insertion of the light pipe 18 thereby establishing contact with the two terminals of the bulb 34 as shown in FIG. 12. As a result when the switch 32 is closed electrical current energizes the filament of the bulb 34 causing light to pass through the light pipe 18 and provide the bright light through the clear or polished section 22 thereof and to provide diffused light through the frosted or roughened surface 20 thereof. Obviously the rubber tip 30 may be placed on the end of the light pipe 18 before or after the assembly as just described.

It should be readily apparent to those skilled in the art that one of the salient features of the present invention is the easy replacement of the bulb 34 after it has ceased to function. As is evident particularly from FIG. 12, the ball 116 is grasped and move outwardly until the pin 112 exits the opening 62 at which time the light pipe 18 readily drops from the lower portion of the cane 12. In a preferred embodiment of the present invention, a safety lock in the form of an "o" ring 160 is secured around the spring 110 adjacent the ball 116. To activate the release mechanism the "o" ring 160 would first be rolled downwardly, the mechanism activated, the bulb replaced, and the "o" ring returned to the position shown. The bulb 34 may be dumped from the cavity in which it resides simply by turning the light pipe upside down. A new bulb 34 can then be dropped in place in the position as shown in FIG. 12 and the light pipe reinserted by appropriately aligning it with the lower portion of the shaft 12 so that when in place the pin 112 enters the opening 62 as above described. Although an incandescent bulb is illustrated it should be understood that a variety of light sources may be used including a solid state device such as an LED may be used.

It has been found that in some circumstances, during use of the present invention that a "clicking" sound may be created as the pressure exerted by the user overcomes the force of the thrust spring 142. To overcome this tendency, a small "o" ring 162 having a diameter substantially equal to the diameter of the reduced diameter upper portion 60 of the light pipe is disposed against the shoulder formed thereby. This "o" ring functions as a shock absorber or cushion between the metal cane end and the light pipe. Alternatively, the cushion may be formed from a room temperature vulcanizing composition or similar material permanently adhered to the lightpipe.

It is also quite evident from the foregoing description that when the batteries 36 expire they may be easily replaced simply by unscrewing the cap 40, dropping the batteries out, inserting new batteries in place within the handle and screwing the cap back into position. It is therefore readily apparent that the illuminated walking cane of the present invention is quite simple in construction, very easy to maintain and use and will provide a bright light not readily be seen by the user because the cane shaft obscures it and the prefocused bulb 34 directs the light away from the user and can only be seen through the clear and polished portion 22 of the light pipe while at the same time through the reflection between the bulb 34 and the reflector 66 (65) substantially all of the remaining light passes through the frosted section 20 as diffused light. Measurements have shown that through the utilization of the light pipe with the frosted and clear sections as above described approximately 81% of the light generated by the bulb 34 is utilized through both the clear and frosted sections. The light through the clear or polished section 22 of the light pipe is bright enough that it is visible approximately one-half mile away from the user.

Tests have also been conducted and it has been determined that through the utilization of standard "AA" batteries and using a 600 milliampere bulb 34 one would obtain approximately 120 individual uses of the illuminated cane of the present invention on a premise that each use is approximately five minutes in duration. This number of uses obviously would vary depending upon the lifetime of the battery and whether or not a charger was included within the cane.

The apparatus as above described may be constructed as an integral part of a stick used by hikers or walkers. Typically, such a hiking stick would be straight and may have a pointed tip formed of a metal sleeve or the like instead of the rubber tip 30.

There has thus been disclosed an illuminated walking assistance apparatus which is economical, easy to use and easily maintained but does not attract attention when not lighted with both the batteries and the light easily replaceable.

What is claimed is:

1. An illuminated walking assistance apparatus comprising:

an elongated staff having a ground engaging tip portion at one end thereof and a handle at the other end;

said staff including a light pipe disposed adjacent said tip portion and having a clear section and a frosted section;

said clear section of said light pipe defining a cavity therein;

a light emitting member disposed within said cavity which when activated will transmit light through said light pipe to present a bright point of light through said clear section and diffused light through said frosted section; and power means including a switch disposed within said staff and adapted to provide electrical energy to activate said light emitting member.

2. The illuminated apparatus as defined in claim 1 which further includes a reflector affixed to the end of said light pipe opposite said cavity for reflecting light transmitted from said light emitting member back along said light pipe toward said light emitting member.

3. The illuminated apparatus of claim 1 which further includes means for releasably attaching said light pipe to said staff, said light emitting member resting within said cavity so that upon release of said light pipe from said staff said light emitting member may be replaced by dumping the old one from the cavity and dropping a new one into the cavity.

4. The illuminated apparatus of claim 1 wherein said light emitting member is a bulb having a filament and when said bulb rests in a lowermost part of said cavity, said filament is aligned with said clear section of said light pipe.

5. The illuminated apparatus of claim 1 wherein said light pipe is an elongated member having first and second ends, said cavity formed as a bore having a blind bottom in said first end and wherein said light emitting member is a pre-focused light bulb with the light transmitting portion thereof resting against said blind bore of said cavity and which further includes a reflector affixed to the second end of said elongated member.

6. The illuminated apparatus of claim 5 wherein said elongated member defines a transverse opening within the wall thereof and which further includes a pin extending through said staff and into said transverse opening for releasably attaching said light pipe to said staff.

7. The illuminated apparatus of claim 6 which further includes inner and outer spring loaded electrically conductive tubes separated by insulating means disposed within said staff adjacent the first end of said elongated light pipe and adapted to engage said bulb when said light pipe is received within said staff, said inner and outer tubes being connected to said power means for activating said light emitting member when said switch is closed.

8. The illuminated apparatus of claim 1 wherein said handle defines an opening extending therethrough and which further includes an electrically conductive tube disposed within said opening, a threadably removable plug closing one end of said tube, battery means disposed within said tube, electrical contact means disposed internally of said tube with said contact means and said plug providing electrical contact to opposite terminals of said battery means.

9. The illuminated apparatus of claim 3 wherein said means for releasably attaching includes a spring like strap affixed to said staff and including a pin member extending through said staff into engagement with said light pipe.

10. The illuminated apparatus of claim 9 wherein said light pipe is an elongated member having first and second ends and a blind bore extending from said first end to define said cavity and which further includes a transverse opening in said elongated member, said transverse opening receiving said pin when said light pipe is attached to said staff.

* * * * *